US012760498B2

(12) United States Patent
Yamaguchi et al.

(10) Patent No.: US 12,760,498 B2
(45) Date of Patent: Oct. 13, 2026

(54) ELECTRIC EXCAVATOR

(71) Applicant: KOMATSU LTD., Tokyo (JP)

(72) Inventors: Masaho Yamaguchi, Tokyo (JP); Takeshi Kitagawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 205 days.

(21) Appl. No.: 18/579,925

(22) PCT Filed: Jun. 17, 2022

(86) PCT No.: PCT/JP2022/024379

§ 371 (c)(1),
(2) Date: Jan. 17, 2024

(87) PCT Pub. No.: WO2023/007981

PCT Pub. Date: Feb. 2, 2023

(65) Prior Publication Data

US 2024/0240433 A1 Jul. 18, 2024

(30) Foreign Application Priority Data

Jul. 30, 2021 (JP) ..... 2021-125573

(51) Int. Cl.
*E02F 9/08* (2006.01)

(52) U.S. Cl.
CPC ..... *E02F 9/0866* (2013.01)

(58) Field of Classification Search
CPC ..... E02F 9/0866
See application file for complete search history.

(56) References Cited

U.S. PATENT DOCUMENTS

| | | | | |
|---|---|---|---|---|
| 6,540,036 | B1 | 4/2003 | Sugano | |
| 12,371,877 | B2 * | 7/2025 | Kitahara | B60L 9/00 |
| 2002/0104239 | A1 | 8/2002 | Naruse et al. | |
| 2004/0098983 | A1 | 5/2004 | Naruse et al. | |
| 2009/0199553 | A1 | 8/2009 | Nishimura et al. | |
| 2012/0285757 | A1 | 11/2012 | Atarashi et al. | |
| 2013/0071212 | A1 * | 3/2013 | Yunoue | E02F 9/0883 414/685 |
| 2013/0075171 | A1 | 3/2013 | Noguchi et al. | |
| 2017/0016206 | A1 | 1/2017 | Ota et al. | |
| 2023/0167623 | A1 * | 6/2023 | Kitahara | E02F 9/0866 |
| 2023/0366175 | A1 * | 11/2023 | Whiteman | B60H 1/00378 |
| 2023/0417019 | A1 * | 12/2023 | Kitahara | E02F 9/207 |

(Continued)

FOREIGN PATENT DOCUMENTS

| | | | |
|---|---|---|---|
| CN | 102725454 | A | 10/2012 |
| JP | 2000-054430 | A | 2/2000 |
| JP | 2002-227241 | A | 8/2002 |

(Continued)

*Primary Examiner* — Brian L Swenson
(74) *Attorney, Agent, or Firm* — Faegre Drinker Biddle & Reath LLP

(57) ABSTRACT

An exterior cover includes a left side panel and a right side panel opposite to each other in a left/right direction, a vent provided in left side panel, and a vent provided in right side panel. A battery is arranged between left side panel and right side panel, and supplies power to an electric motor. A hydraulic equipment is arranged forward of battery. A cooling device includes a cooling fan, and is arranged facing an area located between battery and hydraulic equipment in plan view in the left/right direction.

7 Claims, 6 Drawing Sheets

(56) References Cited

U.S. PATENT DOCUMENTS

| | | | | |
|---|---|---|---|---|
| 2024/0018744 | A1* | 1/2024 | Carton | E02F 9/207 |
| 2025/0092638 | A1* | 3/2025 | Kanai | E02F 9/0866 |

FOREIGN PATENT DOCUMENTS

| | | | |
|---|---|---|---|
| JP | 2004-169464 | A | 6/2004 |
| JP | 2004-169465 | A | 6/2004 |
| JP | 2007-224585 | A | 9/2007 |
| JP | 4520649 | B2 | 8/2010 |
| JP | 2011-149157 | A | 8/2011 |
| JP | 2012-001933 | A | 1/2012 |
| JP | 2012-041819 | A | 3/2012 |
| JP | 2016-030924 | A | 3/2016 |
| KR | 10-2001-0050819 | A | 6/2001 |
| KR | 10-2012-0130086 | A | 11/2012 |
| KR | 10-2013-0028034 | A | 3/2013 |

* cited by examiner

ELECTRIC EXCAVATOR

TECHNICAL FIELD

The present disclosure relates to an electric excavator.

BACKGROUND ART

Technology for cooling a battery in a small electric excavator is disclosed, for example, in Japanese Patent Laying-Open No. 2012-1933 (Patent Literature 1). In Patent Literature 1, one end of a duct is connected to an upper surface of a covering sheet that covers an upper surface and a side surface of a battery storage structure. The other end of the duct is connected to a machine compartment that is configured for forced exhaust by a cooling fan. The machine compartment includes a hydraulic pump, an electric motor, an oil tank, a heat exchanger, an oil cooler, and the like arranged therein.

CITATION LIST

Patent Literature

PTL 1: Japanese Patent Laying-Open No. 2012-1933

SUMMARY OF INVENTION

Technical Problem

A medium or large electric excavator requires a large-sized battery, which results in a larger space occupied by the battery in an exterior cover. Therefore, it is necessary to review the arrangement of components such as hydraulic equipment (a hydraulic oil tank, a main valve), and the electric motor. Consequently, the hydraulic equipment is likely to be arranged near the battery.

While an allowable temperature for the battery to function stable is low, the hydraulic equipment such as a hydraulic oil tank, the main valve, and the like generates a lot of heat during operation, which results in a high ambient temperature. Therefore, when the hydraulic equipment is arranged near the battery, the heat transferred from the hydraulic equipment to the battery causes the battery to heat up beyond the allowable temperature, which may result in loosening of a stable functioning of the battery.

An object of the present disclosure is to provide an electric excavator capable of reducing battery heating due to heat transfer from hydraulic equipment.

Solution to Problem

An electric excavator of the present disclosure includes an exterior cover, a battery, hydraulic equipment, and a cooling device. The exterior cover includes a first side panel and a second side panel opposite to each other in a left/right direction, a first vent provided in the first side panel, and a second vent provided in the second side panel. The battery is arranged between the first side panel and the second side panel, and supplies power to a power source. The hydraulic equipment is arranged forward of the battery. The cooling device includes a cooling fan, and is arranged facing an area located between the battery and the hydraulic equipment in plan view in the left/right direction.

Advantageous Effects of Invention

According to the present disclosure, it is possible to realize an electric excavator capable of reducing heating of the battery due to heat transfer from the hydraulic equipment.

DESCRIPTION OF EMBODIMENTS

Figure 1:
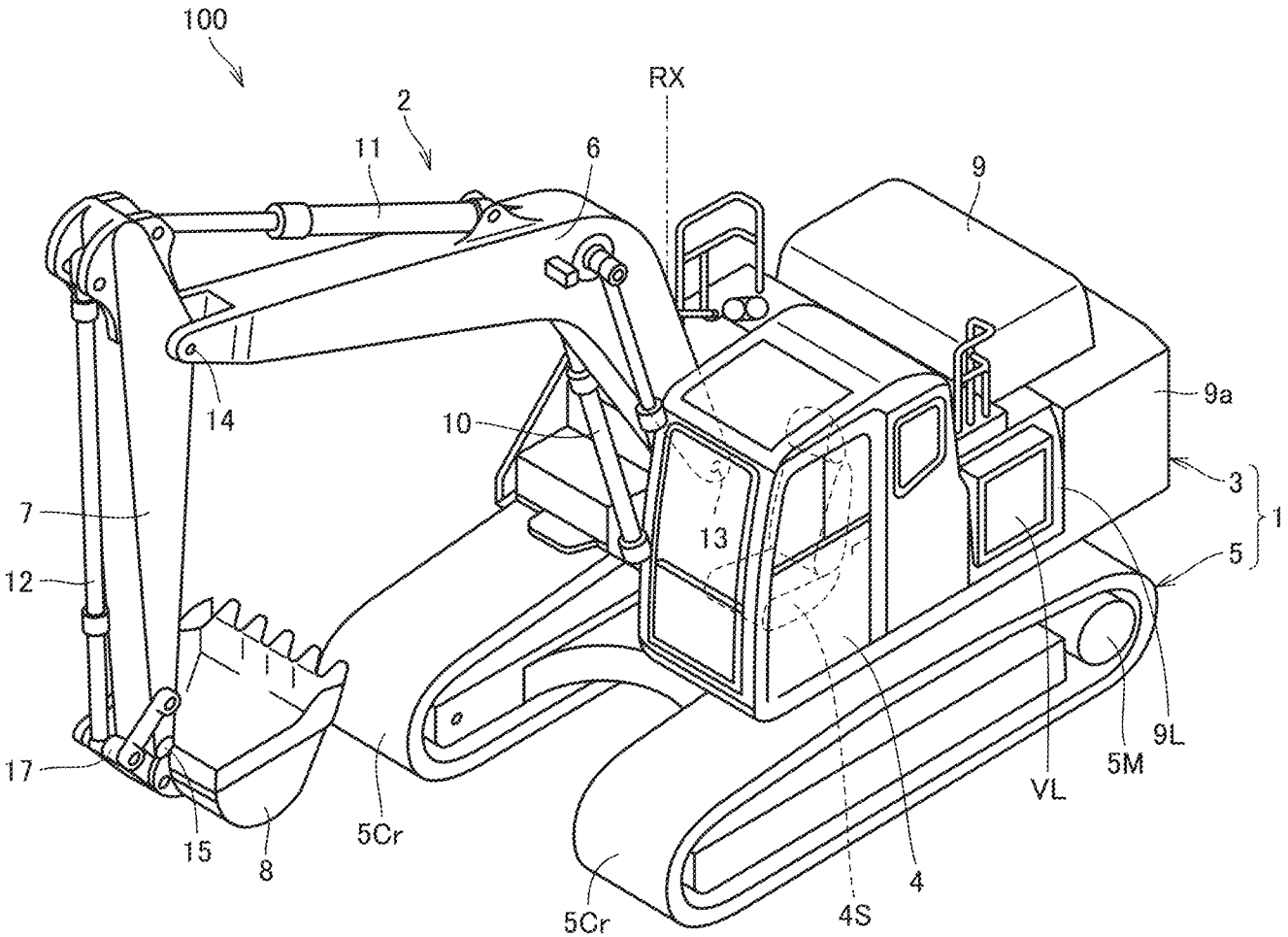
FIG. 1 is a perspective view schematically illustrating a configuration of an electric excavator according to an embodiment of the present disclosure.

Referring now to the drawings, embodiments of the present disclosure will be described.

In the specification and drawings, identical or corresponding components will be designated by the same reference signs, and duplicate explanations will not be repeated. In the drawings, the configurations may be omitted or may be simplified for convenience of explanation. At least parts of the embodiments and modifications may be combined with each other as needed.

In the following description, "up", "down", "front", "rear", "left", and "right" are directions with respect to an operator seated on an operating seat 4S in an operator's cab 4 illustrated in FIG. 1.

<Configuration of Electric Excavator>

Referring first to FIG. 1, a configuration of an electric excavator of the present embodiment will be described.

FIG. 1 is a perspective view schematically illustrating a configuration of the electric excavator according to an embodiment of the present disclosure. As illustrated in FIG. 1, an electric excavator 100 includes a main body 1 and a work implement 2 that works by hydraulic pressure. Main body 1 includes a revolving unit 3 and a travel unit 5.

Travel unit 5 includes a pair of crawler belts 5Cr and a travel motor 5M. Electric excavator 100 can travel by rotation of crawler belt 5Cr. Travel motor 5M is provided as a driving source for travel unit 5. Travel motor 5M is a hydraulic motor operated by hydraulic pressure. Note that travel unit 5 may have wheels (tires).

Revolving unit 3 is arranged on travel unit 5, and is supported by travel unit 5. Revolving unit 3 can be revolved by a slewing motor (not illustrated) about a revolution axis RX with respect to travel unit 5. The slewing motor is a hydraulic motor operated by hydraulic pressure. Revolution axis RX is a hypothetical straight line that serves as a center of revolution of revolving unit 3. Note that travel motor 5M or the slewing motor may be an electric motor.

Revolving unit 3 includes operator's cab 4 (cab). In operator's cab 4, operating seat 4S on which the operator is to seat is provided. The operator (occupant) can board operator's cab 4 for operation of work implement 2, revolving operation of revolving unit 3 with respect to travel unit 5, and traveling operation of electric excavator 100 by travel unit 5. Revolving unit 3 includes an exterior cover 9. Exterior cover 9 covers the machine compartment. The electric excavator may be configured to be remotely operated.

Work implement 2 is supported by revolving unit 3. Work implement 2 includes a boom 6, a dipper stick 7, and a bucket 8. Work implement 2 further includes a boom cylinder 10, a dipper stick cylinder 11, and a bucket cylinder 12.

Boom 6 is rotatably connected to main body 1. Specifically, a proximal end of boom 6 is connected to revolving unit 3 rotatably about a boom foot pin 13 as a pivot point. Dipper stick 7 is rotatably connected to boom 6. Specifically, a proximal end of dipper stick 7 is connected to a distal end of boom 6 rotatably about a boom top pin 14 as a pivot point. Bucket 8 is rotatably connected to dipper stick 7. Specifically, a proximal end of bucket 8 is connected to a distal end of dipper stick 7 rotatably about a dipper stick top pin 15 as a pivot point.

One end of boom cylinder 10 is connected to revolving unit 3, and the other end is connected to boom 6. Boom 6 can be driven by boom cylinder 10 with respect to main body 1. This drive allows boom 6 to pivot in the up/down direction with respect to revolving unit 3 about boom foot pin 13 as a pivot point.

One end of dipper stick cylinder 11 is connected to boom 6, and the other end is connected to dipper stick 7. Dipper stick 7 can be driven by dipper stick cylinder 11 with respect to boom 6. This drive allows dipper stick 7 to pivot in the up/down direction or the fore/aft direction with respect to boom 6 about boom top pin 14 as a pivot point.

One end of bucket cylinder 12 is connected to dipper stick 7, and the other end is connected to a bucket link 17. Bucket 8 can be driven by bucket cylinder 12 with respect to dipper stick 7. This drive allows bucket 8 to pivot in the up/down direction with respect to dipper stick 7 about dipper stick top pin 15 as a pivot point.

Each of boom cylinder 10, dipper stick cylinder 11, and bucket cylinder 12 is a hydraulic cylinder and is driven by hydraulic pressure.

<Side Panel of Exterior Cover and Arrangement of Components in Machine Compartment>

Subsequently, referring now to FIG. 2 to FIG. 7, a side panel of the exterior cover and arrangement of components in the machine compartment in the electric excavator illustrated in FIG. 1 will be described. Note that part of exterior cover 9 is shown broken in FIG. 2 and FIG. 3.

Figure 2:
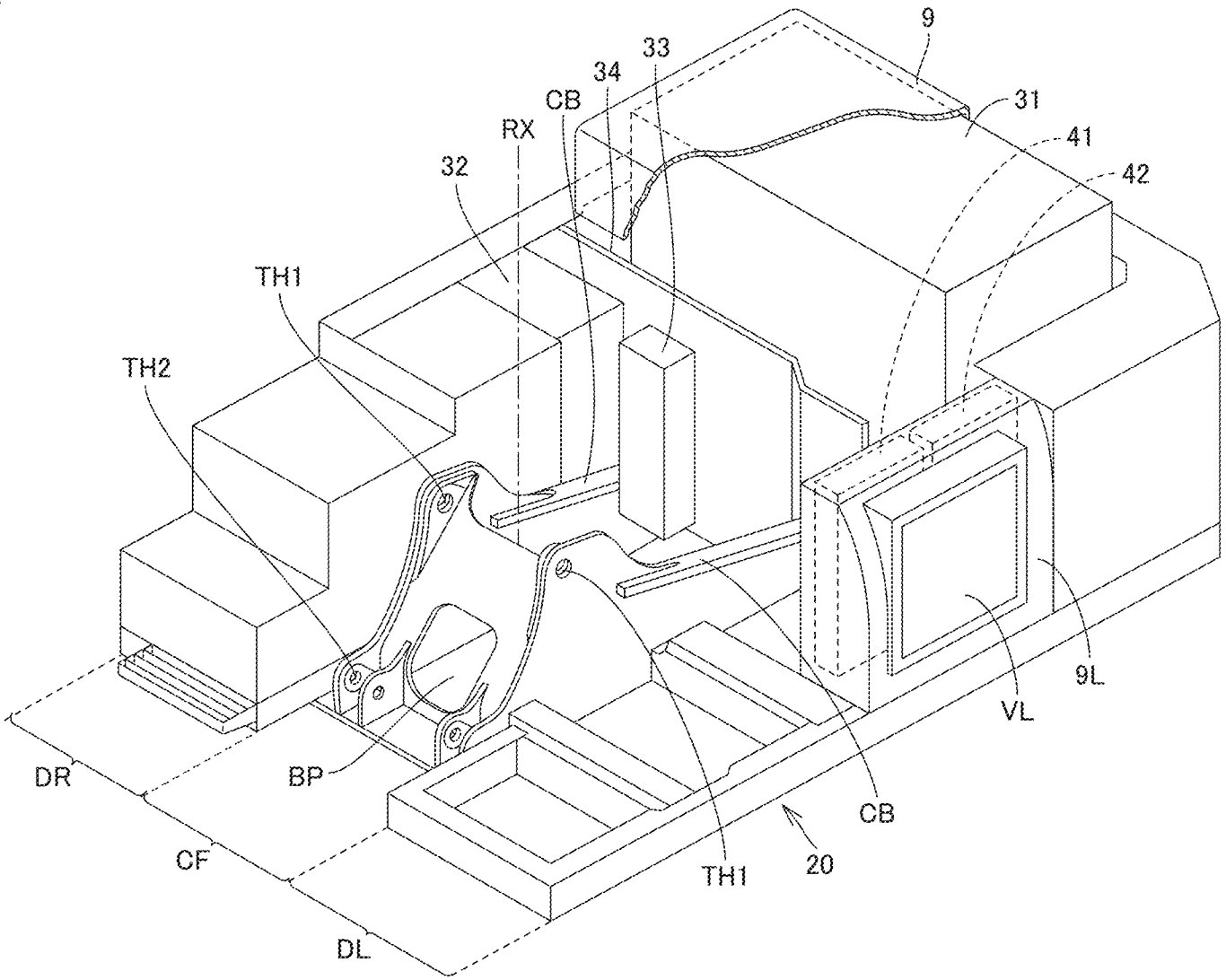
FIG. 2 is a first perspective view illustrating a state of an interior of a machine compartment in the electric excavator illustrated in FIG. 1.
Figure 3:
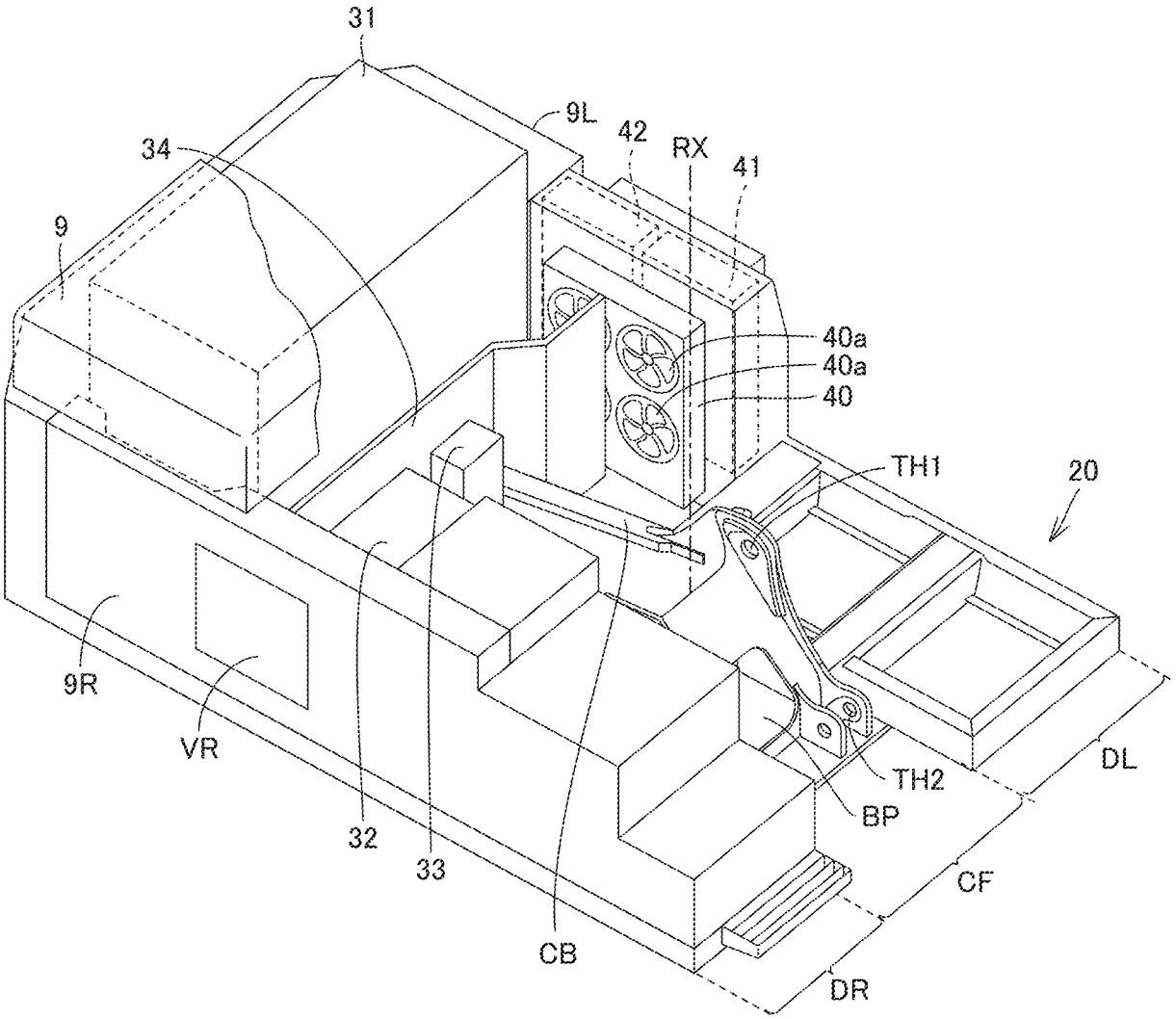
FIG. 3 is a second perspective view illustrating the state of the interior of the machine compartment in the electric excavator illustrated in FIG. 1.
Figure 4:
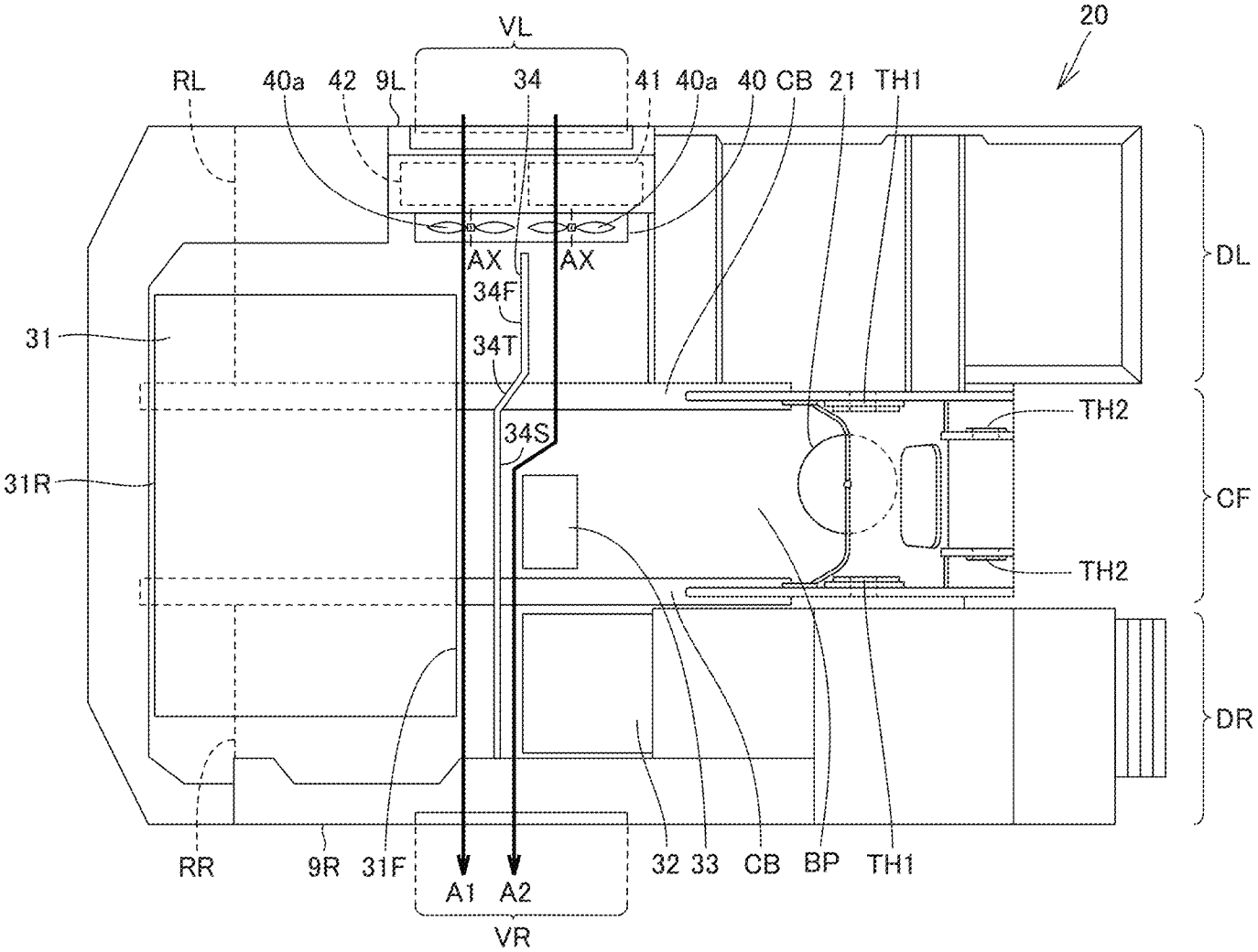
FIG. 4 is a plan view illustrating the state of the interior of the machine compartment in the electric excavator illustrated in FIG. 1.

Each of FIG. 2 and FIG. 3 is a perspective view illustrating a state of an interior of the machine compartment in the electric excavator illustrated in FIG. 1. FIG. 4 is a plan view illustrating the state of the interior of the machine compartment in the electric excavator illustrated in FIG. 1. As illustrated in FIG. 2, revolving unit 3 (FIG. 1) includes a revolving frame 20. Revolving frame 20 revolves with respect to travel unit 5 (FIG. 1) about revolution axis RX.

Revolving frame 20 includes a center frame CF, a left deck DL, and a right deck DR. Center frame CF is positioned approximately in the center of revolving frame 20 in the left/right direction. Left deck DL is arranged on the left side of center frame CF. Right deck DR is arranged on the right side of center frame CF.

Center frame CF includes a pair of center beams CB. The pair of center beams CB are arranged opposite to each other with spacing therebetween in the left/right direction. The pair of center beams CB supports work implement 2 (FIG. 1). This makes center frame CF support work implement 2.

The pair of center beams CB include through holes TH1 and TH2, respectively. Boom foot pin 13 (FIG. 1) is inserted through the through hole TH1. Boom 6 (FIG. 1) is rotatably supported on the pair of center beams CB by boom foot pin 13.

A pin (not illustrated) for supporting boom cylinder 10 (FIG. 1) is inserted through the through hole TH2. Boom cylinder 10 is rotatably supported on center beam CB by this pin.

As illustrated in FIG. 3, installed devices such as a battery 31, a hydraulic oil tank 32, a selector valve 33 (main valve), a partitioning member 34, a cooling device 40, an oil cooler 41, a radiator 42, and operator's cab 4 (FIG. 1) is supported on revolving frame 20. Battery 31, hydraulic oil tank 32, selector valve 33, cooling device 40 and the like are arranged in the machine compartment covered by exterior cover 9 (FIG. 1).

Cooling device 40 includes, for example, four cooling fans 40*a*. Two cooling fans 40*a* are arranged in the up/down direction, and two cooling fans 40*a* are arranged in the fore/aft direction, so that four, in total, cooling fans 40*a* are arranged.

Battery 31 includes, for example, a plurality of battery modules, and each of the plurality of battery modules includes a battery cell. Battery 31 is a power supply, and stores electrical energy obtained from an external power supply. Battery 31 extracts stored electrical energy as electromotive force. Battery 31 supplies power to the electric motor (not illustrated) via an inverter (not illustrated). Battery 31 is a lithium-ion, an electric double layer capacitor, a lead-acid battery, or the like. Battery 31 is a rechargeable battery (storage battery).

Battery 31 is arranged on the pair of center beams CB via brackets (not illustrated). Electric excavator 100 in the present embodiment does not have a counterweight, and battery 31 serves as the counterweight. Battery 31 is therefore arranged at the rear of revolving unit 3.

As illustrated in FIG. 4, the area behind each of a rear end RL of left deck DL and a rear end RR of right deck DR is essentially an area where the counterweight is arranged. Battery 31 has a portion located behind each of rear end RL of left deck DL and rear end RR of right deck DR in plan view to serve as the counterweight. Therefore, a rear end 31R of battery 31 is located behind each of rear end RL of left deck DL and rear end RR of right deck DR in plan view. As used herein the term "plan view" means a viewpoint looking from top to bottom in the direction orthogonal to a bottom plate BP of revolving frame 20 (up/down direction).

In medium or large electric excavators, the amount of energy required to operate the excavator is greater, so battery 31 is also larger. Increasing the height of battery 31 will reduce the rear visibility of the operator seated in operating seat 4S. Reducing the height of battery 31 in turn will increase the flat area occupied by battery 31. Therefore, battery 31 does not fit into the counterweight placement area in plan view and protrudes into the machine compartment.

Accordingly, a front end 31F of battery 31 is located forward of each of rear end RL of left deck DL and rear end RR of right deck DR in plan view. Such protrusion of battery 31 into the machine compartment places restrictions on the placement of installed devices other than battery 31.

Note that the machine compartment means the space located forward of each of rear end RL of left deck DL and rear end RR of right deck DR, which is covered by exterior cover 9.

Hydraulic equipment (hydraulic oil tank 32, selector valve 33, hydraulic pump (not illustrated), and the like) is located forward of battery 31. The inverters, the electric motors, and the like are also located forward of battery 31.

Battery 31 supplies power to the electric motor (not illustrated) as the power source. Specifically, battery 31 supplies power to the inverter through electrical wiring. The inverter converts DC power, which is the output of battery 31, into AC power with controlled frequency, etc. The inverter supplies AC power to the electric motor through electrical wiring. This causes the electric motor to be driven by AC power supplied by the inverter, using battery 31 as the power supply.

The electric motor and the hydraulic pump are mechanically coupled. The driving force of the electric motor is transmitted to the hydraulic pump, which in turn drives the hydraulic pump. The hydraulic pump, when driven, pumps hydraulic oil from hydraulic oil tank 32. The hydraulic pump supplies hydraulic oil pumped out from hydraulic oil tank 32 to each hydraulic actuator (travel motor 5M, the slewing motor, and each hydraulic cylinder 10-12) through selector valve 33.

Selector valve 33 is configured as an assembly of a number of control valves, pilot valves, etc. Selector valve 33 is arranged in the oil path (hydraulic piping) between the hydraulic pump and the hydraulic actuator. Selector valve 33 supplies and discharges hydraulic oil pumped out from hydraulic oil tank 32 by the hydraulic pump to the hydraulic actuator. Each hydraulic actuator is activated by the supply and discharge of hydraulic oil from selector valve 33.

The opening and closing of each valve in selector valve 33 are controlled according to the driving operation by the operator. This allows main body 1 and work implement 2 of electric excavator 100 to be operated according to the driving operation of the operator boarded operator's cab 4. Specifically, the operator can operate work implement 2 by operating hydraulic cylinders 10-12, can operate the revolution of revolving unit 3 by operating the slewing motor and can operate the traveling of electric excavator 100 by operating travel motor 5M.

As illustrated in FIG. 2, exterior cover 9 has a left side panel 9L (first side panel). Left side panel 9L is provided with a vent VL (first vent). Vent VL is a through hole provided in left side panel 9L and is, for example, a rectangular through hole with a net attached thereto. Vent VL may be a plurality of through holes formed by punching out a material such as metal, for example, perforated metal.

As illustrated in FIG. 3, exterior cover 9 has a right side panel 9R (second side panel). Right side panel 9R is provided with a vent VR (second vent). Vent VR is a through hole provided in right side panel 9R. Vent VR is a plurality of through holes formed by punching out a material such as metal, for example, perforated metal.

As illustrated in FIG. 4, left side panel 9L and right side panel 9R of exterior cover 9 face each other in the left/right direction. Vent VL provided in left side panel 9L, and vent VR provided in right side panel 9R face each other in the left/right direction.

In plan view, battery 31, the hydraulic equipment (hydraulic oil tank 32, selector valve 33), partitioning member 34, cooling device 40, oil cooler 41, and radiator 42 are arranged between left side panel 9L and right side panel 9R. Each of cooling device 40, oil cooler 41, and radiator 42 is arranged within the area linearly connecting vent VL and vent VR. The area located between battery 31 and hydraulic equipment 32 and 33 is arranged within the area linearly connecting vent VL and vent VR. Each of hydraulic oil tank 32 and selector valve 33 may also be arranged within the area linearly connecting vent VL and vent VR. Part of battery 31 may be arranged within the area linearly connecting vent VL and vent VR.

Hydraulic oil tank 32 is arranged on right deck DR, for example. Hydraulic oil tank 32 is arranged forward of battery 31 with a gap from battery 31. Selector valve 33 is arranged in center frame CF. Selector valve 33 is arranged forward of battery 31 with a gap from battery 31.

Each of hydraulic oil tank 32 and selector valve 33 is arranged behind an opening 21 provided in center frame CF. Opening 21 is a through opening through which, for example, a swivel joint (not illustrated) is inserted and serves as the center of revolution of revolving frame 20. Opening 21 is provided in bottom plate BP of center frame CF.

Each of cooling device 40, oil cooler 41 and radiator 42 is arranged on left deck DL, for example. Each of oil cooler 41 and radiator 42 is positioned side-by-side with cooling device 40 in the left/right direction. Cooling device 40 in plan view is arranged facing the area located between battery 31 and hydraulic equipment 32 and 33 in the left/right direction. Note that each of cooling device 40, oil cooler 41 and radiator 42 may be arranged, for example, on right deck DR.

Cooling device 40 includes a plurality of cooling fans 40*a*. Cooling device 40 flows air between vent VL and vent VR by driving a plurality of cooling fans 40*a*. Cooling device 40, driven by a plurality of cooling fans 40*a*, discharges air taken in from the exterior to the interior of the machine compartment through vent VL, for example, as illustrated by arrows A1 and A2 in FIG. 4, from the interior to the exterior of the machine compartment through vent VR after the passage between battery 31 and hydraulic equipment 32 and 33. This allows air, taken in from the exterior into the interior of the machine compartment through vent VL, passes through a space located between a front surface of battery 31 and rear surfaces of hydraulic equipment 32 and 33, and is discharged from the interior to the exterior of the machine compartment through vent VR.

Cooling device 40, driven by a plurality of cooling fans 40*a*, may pass air taken in from the exterior to the interior of the machine compartment through vent VR between battery 31 and hydraulic equipment 32, 33, and then discharge the air from the interior to the exterior of the machine compartment through vent VL, for example. In this case, vent VR through which air is taken into the machine compartment corresponds to first vent, and vent VL through which air is discharged from the machine compartment corresponds to the second vent. Right side panel 9R with vent VR corresponds to the first side panel, and left side panel 9L with vent VL corresponds to the second side panel.

Partitioning member 34 is a plate-shaped member made, for example, of s steel plate. Partitioning member 34 extends in the left/right direction. Partitioning member 34 is arranged between battery 31 and hydraulic equipment 32 and 33. Specifically, partitioning member 34 extends from near cooling device 40, through between battery 31 and selector valve 33, and between battery 31 and hydraulic oil tank 32 to near right side panel 9R. Partitioning member 34 extends from left deck DL across center frame CF to right deck DR.

Partitioning member 34 includes a first portion 34F, a second portion 34S, and a third portion 34T. First portion 34F is connected to the left end (one end) of third portion 34T and extends linearly along the left/right direction from the left end. Second portion 34S is connected to the right end (the other end) of third portion 34T and extends linearly along the left/right direction from the right end. First portion 34F and second portion 34S extend parallel to each other, for example, in plan view. Third portion 34T extends linearly, inclined with respect to each of first portion 34F and second portion 34S in plan view.

The left end of third portion 34T is located forward of the right end of third portion 34T. Third portion 34T is inclined with respect to the left/right direction so as to be positioned rearward as it goes from the left end to the right end.

In plan view, a gap (space) is provided between battery 31 and partitioning member 34. Each of the front surface of battery 31 and the rear surface of partitioning member 34 face the gap. The front surface of battery 31 and the rear surface of partitioning member 34 face each other with a gap therebetween in the fore/aft direction.

In plan view, a gap is provided between partitioning member 34 and hydraulic oil tank 32 and between partitioning member 34 and selector valve 33. Each of the rear surface of hydraulic oil tank 32, the rear surface of selector valve 33, and the front surface of partitioning member 34 face the gap. The rear surface of hydraulic oil tank 32 and the front surface of partitioning member 34 face each other with a gap therebetween in the fore/aft direction. The rear surface of selector valve 33 and the front surface of partitioning member 34 face each other with a gap therebetween in the fore/aft direction.

Cooling device 40 sends air to the area on battery 31 side relative to partitioning member 34 as indicated by arrow A1. Cooling device 40 also sends air to the area on hydraulic equipment 32 and 33 side relative to partitioning member 34 as indicated by arrow A2. Air, indicated by arrow A1, flows into the gap between the rear surface of partitioning member 34 and the front surface of battery 31. The air indicated by arrow A2 flows into a gap between the front surface of partitioning member 34 and the rear surface of selector valve 33 and into a gap between the front surface of partitioning member 34 and the rear surface of hydraulic oil tank 32, respectively.

Cooling device 40 is located within the area linearly connecting vent VL and vent VR. Rotation axes AX of cooling fans 40*a* of cooling device 40 extend in a direction that linearly connects vent VL and vent VR (the direction from vent VL to vent VR). Rotation axis AX, for example, extends along the left/right direction.

At least part of cooling device 40 faces vent VR without any obstacle therebetween. This allows at least part of the air delivered from cooling device 40 to flow linearly without colliding with obstacles, reach vent VR, and be discharged through vent VR.

Cooling fan 40*a* at the front row in cooling device 40 is arranged facing each of selector valve 33 and hydraulic oil tank 32 in the left/right direction. This allows part of the air delivered from cooling device 40 to flow linearly from cooling device 40 and directly hit hydraulic equipment 32 and 33.

Cooling fan 40*a* at the rear row in cooling device 40 is arranged facing battery 31 in the left/right direction. This allows part of the air delivered from cooling device 40 to flow linearly from cooling device 40 and directly hit battery 31.

Oil cooler 41 is, for example, a device for cooling the hydraulic oil used to operate the hydraulic actuators (travel motor 5M, the slewing motor, and each hydraulic cylinder 10-12). Oil cooler 41 has, for example, a tube through which hydraulic oil passes and a fin attached to the tube.

Radiator 42 is a device for cooling the cooling medium (e.g., cooling water) for, for example, battery 31, the electric motor, and the inverter. Radiator 42 has, for example, a tube through which the cooling medium passes, and a fin attached to the tube.

Oil cooler 41 and radiator 42 are aligned with each other in the fore/aft direction. Oil cooler 41 is located forward of radiator 42. Oil cooler 41 is arranged facing hydraulic equipment 32 and 33 in the direction in which rotation axis AX of cooling fan 40*a* extends and is positioned side-by-side with hydraulic equipment 32 and 33 in the left/right direction. Oil cooler 41 is, for example, arranged facing cooling fan 40*a* at the front row in cooling device 40 in the left/right direction.

Radiator 42 is arranged facing battery 31 in the direction in which rotation axis AX of cooling fan 40*a* extends and is positioned side-by-side with battery 31 in the left/right direction. Radiator 42 is, for example, arranged facing cooling fan 40*a* at the rear row in cooling device 40 in the left/right direction.

The position of the left end of partitioning member 34 in the fore/aft direction is located, for example, between two cooling fans 40*a* in the fore/aft direction. This allows cooling fan 40*a* located at the rear row in the fore/aft direction to send air to the area on battery 31 side relative to partitioning member 34. This allows cooling fans 40*a* located at the front row in the fore/aft direction to send air to the area on hydraulic equipment 32, 33 side relative to partitioning member 34.

As illustrated in FIG. 3, an upper end of partitioning member 34 is located above an upper surface of hydraulic oil tank 32 and an upper end of selector valve 33. This effectively prevents oil blown from hydraulic oil tank 32 and selector valve 33 from contaminating battery 31.

Figure 5:
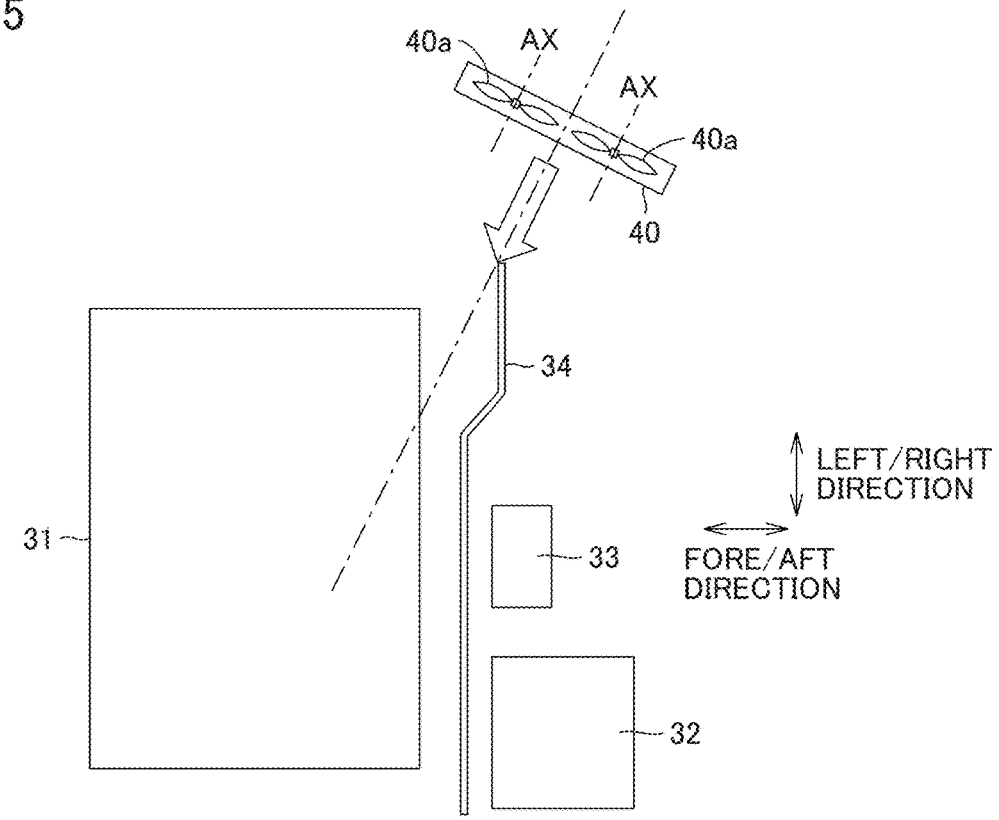
FIG. 5 is a schematic plan view illustrating a state in which the direction of a rotation axis of a fan is inclined with respect to the left/right direction.

Rotation axes AX of cooling fans 40*a* in cooling device 40 extend in the left/right direction (orthogonal to the fore/aft direction) in plan view. However, as illustrated in FIG. 5, rotation axes AX of cooling fans 40*a* may be inclined with respect to the left/right direction in plan view. Specifically, in plan view, rotation axis AX may be inclined so as to extend from the front to the rear as it goes from the left side to the right side in the left/right direction. It may also be inclined so as to extend from the rear to the front as it goes from one side (e.g., left side) to the other (e.g., right side) in the left/right direction. The hypothetical extension line of rotation axis AX extends into an area located between battery 31 and hydraulic equipment 32 and 33.

Figure 6:
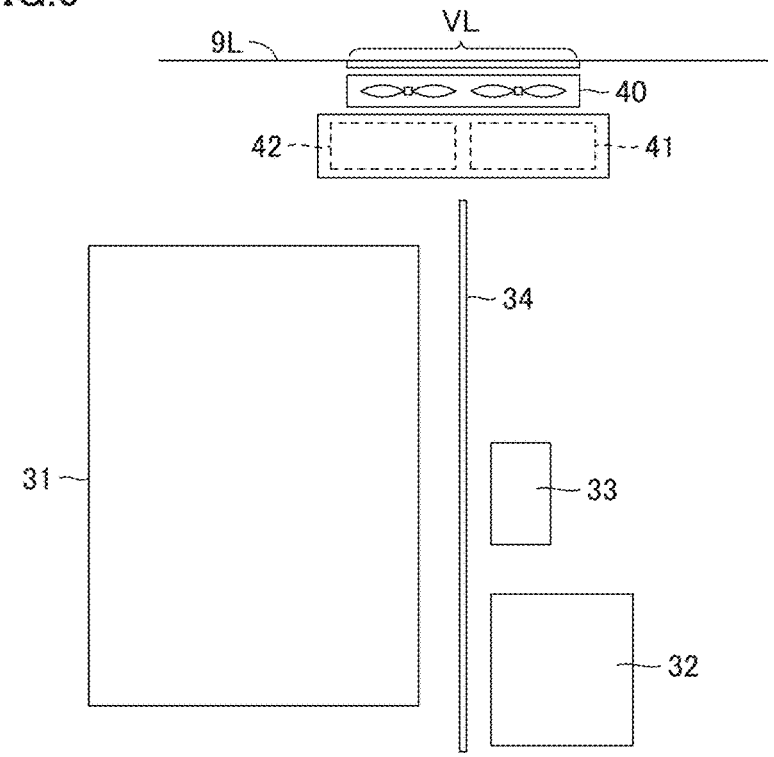
FIG. 6 is a schematic plan view illustrating a state in which a vent hole, the fan, and an oil cooler (or radiator), and the battery are arranged in this order in the left/right direction.

As illustrated in FIG. 6, each of oil cooler 41 and radiator 42 may be arranged on opposite side from left side panel 9L with respect to cooling device 40. In other words, vent VL may be arranged on one side (e.g., left side) of cooling device 40 in the left/right direction, and oil cooler 41 and radiator 42 may be arranged on the other side (e.g., right side) of cooling device 40 in the left/right direction.

Partitioning member 34 may extend linearly in the left/right direction entirely from the left end to the right end in plan view, without having third portion 34T, which is an inclined portion as illustrated in FIG. 4.

In the above embodiment, a configuration with partitioning member 34 has been described, but partitioning member 34 may be omitted. In this case, the front surface of battery 31 and the rear surface of each of hydraulic equipment 32 and 33 face each other in the fore/aft direction with a gap therebetween.

Figure 7:
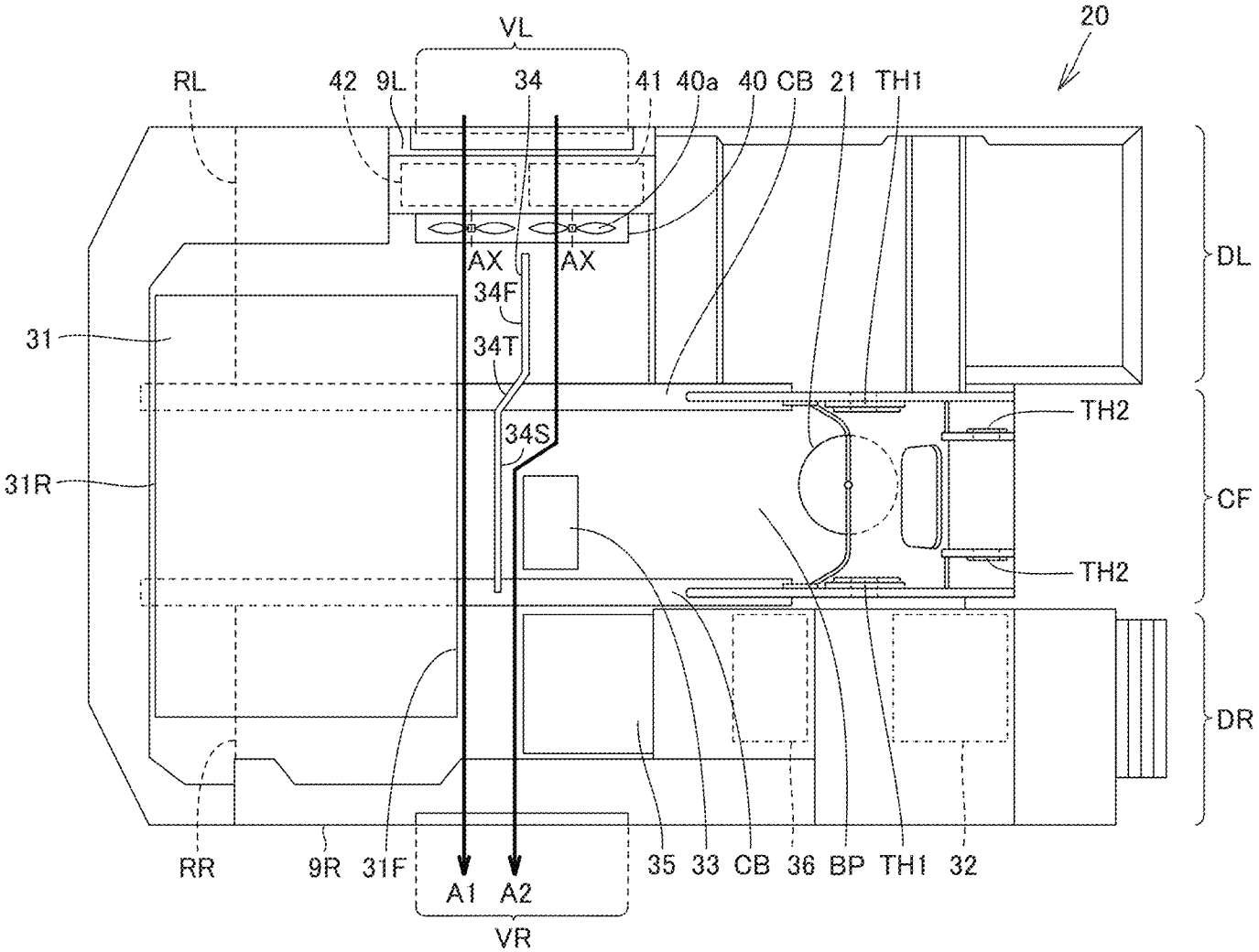
FIG. 7 is a plan view illustrating a modification of a state in the interior of the machine compartment in the electric excavator illustrated in FIG. 1.

The arrangement of components in the machine compartment is not limited to the arrangement illustrated in FIG. 4 but may be an arrangement of a modification illustrated in FIG. 7, for example. In the arrangement of the modification illustrated in FIG. 7, an electric motor 35, an inverter 36, and hydraulic oil tank 32 are arranged in this order on right deck DR forward of battery 31. Specifically, electric motor 35 is arranged forward of battery 31, inverter 36 is arranged forward of electric motor 35, and hydraulic oil tank 32 is arranged forward of inverter 36. A hydraulic pump (not illustrated) is arranged below inverter 36.

In such an arrangement, partitioning member 34 should only be located at least between battery 31 and selector valve 33. In this modification, partitioning member 34 extends in the left/right direction from near cooling device 40 to near between battery 31 and selector valve 33. In the present embodiment, partitioning member 34 extends to near selector valve 34 because there is a cable between electric motor 35 and battery 31, but it may extend to the right end as in FIG. 4.

Note that the configuration of FIG. 7 other than the above is almost the same as that of FIG. 4, and thus identical elements are designated with the same symbols and their explanations are not repeated.

<Effects>

Next, the effects of the present embodiment will be described.

As illustrated in FIG. 4, medium or large electric excavator 100 requires a large-sized battery 31, which results in a larger space occupied by battery 31 in exterior cover 9. Therefore, the hydraulic equipment (hydraulic oil tank 32, selector valve 33) may be arranged near battery 31 in exterior cover 9.

While the allowable temperature of battery 31 is as low as around 60° C., the heat dissipation temperature of hydraulic equipment 32 and 33 is as high as 100° C. Therefore, when hydraulic equipment 32, 33 is arranged near battery 31, the heat transferred from hydraulic equipment 32, 33 to battery 31 causes battery 31 to heat up beyond the allowable temperature, which results in loosening of a stable functioning.

Accordingly, in the present embodiment, cooling device 40 is arranged facing an area located between battery 31 and hydraulic equipment 32, 33 in plan view in the left/right direction as illustrated in FIG. 4. As indicated by arrows A1 and A2 in FIG. 4, cooling device 40 allows air taken in through vent VL to pass between battery 31 and hydraulic equipment 32 and 33, and then be discharged through vent VR. This allows air to flow linearly in the left/right direction from vent VL to vent VR in the machine compartment, which reduces resistance to air flow. This can effectively block heat transfer from hydraulic equipment 32 and 33 to battery 31, and also allows the heat from hydraulic equipment 32 and 33 to be effectively discharged outside the machine compartment. These can reduce heating of battery 31 due to heat transfer from hydraulic equipment 32 and 33.

Note that driving of cooling fan 40*a* may cause the air taken in through vent VR to pass between battery 31 and hydraulic equipment 32 and 33, and then be discharged through vent VL.

In the present embodiment, as illustrated in FIG. 4, partitioning member 34 is arranged between battery 31 and hydraulic equipment 32 and 33. Partitioning member 34 prevents oil blown from hydraulic equipment 32 and 33 from contaminating battery 31, and prevents damage to battery 31 or heavy electrical equipment. Partitioning member 34 can also block heat transfer from hydraulic equipment 32 and 33 to battery 31.

As indicated by arrows A1 and A2 in FIG. 4, in the present embodiment, cooling device 40 sends air to each of the area on battery 31 side relative to partitioning member 34 and the area on hydraulic equipment 32 and 33 side relative to partitioning member 34. As indicated by arrow A2, air is sent to the area on hydraulic equipment 32, 33 side relative to partitioning member 34, thereby reducing heat transfer from hydraulic equipment 32, 33 to partitioning member 34. Likewise, as indicated by arrow A1, air can be sent to the area on battery 31 side relative to partitioning member 34, thereby reducing heat transfer from partitioning member 34 to battery 31. This reduces heat transfer from hydraulic equipment 32 and 33 to battery 31 via partitioning member 34.

In the present embodiment, as illustrated in FIG. 4, at least part of cooling device 40 faces hydraulic equipment 32 and 33 in the direction in which rotation axes AX of cooling fans 40*a* extend. This allows air delivered from cooling device 40 to flow linearly to hydraulic equipment 32 and 33. The air delivered from cooling device 40 thus enables cooling of hydraulic equipment 32 and 33 themselves.

In the area where cooling device 40 and hydraulic equipment 32 and 33 face each other in the direction of rotation axis AX, there may be no obstacle between cooling device 40 and hydraulic equipment 32 and 33. In this case, the air delivered from cooling device 40 directly hits hydraulic equipment 32 and 33, allowing hydraulic equipment 32 and 33 to be cooled more effectively.

In the present embodiment, as illustrated in FIG. 4, at least part of cooling device 40 faces battery 31 in the direction in which rotation axis AX of cooling fan 40*a* extends. This allows the relatively cold (MAX 65° C. or lower) air delivered from cooling device 40 to flow linearly to battery 31. The air delivered from cooling device 40 can therefore cool battery 31 itself.

In the area where cooling device 40 and battery 31 face each other in the direction of rotation axis AX, there may be no obstacle between cooling device 40 and battery 31. In this case, the air delivered from cooling device 40 directly hits battery 31, allowing battery 31 to be cooled more effectively.

In the present embodiment, as illustrated in FIG. 4, oil cooler 41 is arranged facing hydraulic equipment 32, 33 in the direction in which rotation axes AX of cooling fans 40*a* extend, and is positioned side-by-side with hydraulic equipment 32, 33 in the left/right direction. Radiator 42 is arranged facing battery 31 in the direction in which rotation axis AX of cooling fan 40*a* extends and is positioned side-by-side with battery 31 in the left/right direction. This allows cooling device 40 to also cool each of oil cooler 41 and radiator 42.

The embodiment disclosed here are to be considered as examples in all respects and are not limitation. The invention is not defined by the above description, but is defined by claims, and is intended to include any modification within the meaning and scope equivalent to the claims.

REFERENCE SIGNS LIST

1 main body; 2 work implement; 3 revolving unit; 4 operator's cab; 4S operating seat; 5 travel unit; 5Cr crawler belt; 5M travel motor; 6 boom; 7 dipper stick; 8 bucket; 9 exterior cover; 9L left side panel; 9R right side panel; 10 boom cylinder; 11 dipper stick cylinder; 12 bucket cylinder; 13 boom foot pin; 14 boom top pin; 15 dipper stick top pin; 17 bucket link; 20 revolving frame; 21 opening; 31 battery; 31F front end; 31R, RL, RR rear end; 32 hydraulic oil tank; 33 selector valve; 34 partitioning member; 34T third portion; 34F first portion; 34S second portion; 35 electric motor; 36 inverter; 40 cooling device; 40*a* cooling fan; 41 oil cooler; 42 radiator; 100 electric excavator; AX rotation axis; BP bottom plate; CB center beam; CF center frame; DL left deck; DR right deck; RX revolution axis; TH1, TH2 through hole; VL, VR vent

The invention claimed is:

1. An electric excavator comprising:

an exterior cover including a first side panel and a second side panel opposite to each other in a left/right direction, a first vent provided in the first side panel, and a second vent provided in the second side panel;

a battery arranged between the first side panel and the second side panel and supplying power to a power source;

a hydraulic equipment arranged forward of the battery; and a cooling device including a first cooling fan and a second cooling fan, the cooling device arranged facing an area located between the battery and the hydraulic equipment in plan view in the left/right direction, wherein the cooling device is arranged so that the first cooling fan supplies air to a first area on a battery side, and the second cooling fan supplies air to a second area on a hydraulic equipment side, and both the air supplied to the first area to cool the battery and the air supplied to the second area to cool the hydraulic equipment are discharged from the second vent.

2. The electric excavator according to claim 1, wherein the cooling device is configured such that air taken in from the first vent by driving of the first cooling fan passes between the battery and is discharged from the second vent, and air taken in from the first vent by driving of the second cooling fan passes between the hydraulic equipment and is discharged from the second vent.

3. The electric excavator according to claim 1, further comprising a partitioning member arranged between the battery and the hydraulic equipment.

4. The electric excavator according to claim 3, wherein the cooling device is arranged to send air to each of the area on the battery side relative to the partitioning member and the area on the hydraulic equipment side relative to the partitioning member.

5. The electric excavator according to claim 1, wherein at least part of the cooling device faces the hydraulic equipment in a direction in which a rotation axis of the second cooling fan extends.

6. The electric excavator according to claim 1, wherein at least part of the cooling device faces the battery in a direction in which a rotation axis of the first cooling fan extends.

7. The electric excavator according to claim 1, further comprising:

an oil cooler facing the hydraulic equipment in a direction in which a rotation axis of the second cooling fan extends; and a radiator facing the battery in the direction in which the rotation axis of the first cooling fan extends.

* * * * *